US007241183B2

(12) United States Patent
Wasalaski et al.

(10) Patent No.: US 7,241,183 B2
(45) Date of Patent: Jul. 10, 2007

(54) ELECTRICAL CONNECTOR WITH INTEGRATED TERMINAL POSITION ASSURANCE AND WIRE COVER

(75) Inventors: Philip Lee Wasalaski, Bay City, MI (US); David G Matousek, Bay City, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/334,119

(22) Filed: Jan. 18, 2006

(65) Prior Publication Data

US 2006/0172612 A1 Aug. 3, 2006

Related U.S. Application Data

(60) Provisional application No. 60/648,666, filed on Jan. 31, 2005.

(51) Int. Cl.
*H01R 13/502* (2006.01)

(52) U.S. Cl. ..... 439/686; 439/902

(58) Field of Classification Search ..... 439/686, 439/695, 701, 902

See application file for complete search history.

(56) References Cited

U.S. PATENT DOCUMENTS

| | | | | |
|---|---|---|---|---|
| 3,076,171 | A | 1/1963 | Hopkins | 339/258 |
| 4,448,477 | A | 5/1984 | Gladd et al. | 339/258 RR |
| 4,846,737 | A | 7/1989 | Jorroch et al. | 439/752 |
| 4,988,309 | A | 1/1991 | Garretson | 439/318 |
| 5,241,910 | A | 9/1993 | Cunningham et al. | 102/530 |
| 5,314,345 | A | 5/1994 | Cahaly et al. | 439/188 |
| 5,514,006 | A | 5/1996 | Getselis et al. | 439/417 |
| 5,586,902 | A | 12/1996 | Hopf et al. | 439/352 |
| 5,853,298 | A | 12/1998 | Pacher | 439/352 |
| 5,876,231 | A | 3/1999 | Pacher | 439/354 |
| 6,066,008 | A | 5/2000 | Brantingham et al. | 439/752 |
| 6,162,085 | A | 12/2000 | Chugh et al. | 439/467 |
| 6,217,388 | B1 | 4/2001 | Francis | 439/620 |
| 6,422,881 | B1 | 7/2002 | Puhl et al. | 439/140 |
| 6,821,160 | B2 | 11/2004 | Fink et al. | 439/701 |
| 6,837,751 | B2 | 1/2005 | Vanden Wymelenberg et al. | 439/701 |
| 2003/0096527 | A1 | 5/2003 | Greiner | 439/352 |
| 2004/0171288 | A1 | 9/2004 | Banas et al. | 439/135 |

FOREIGN PATENT DOCUMENTS

| | | |
|---|---|---|
| EP | 1006379 A2 | 6/2000 |
| GB | 2352883 A | 2/2001 |

*Primary Examiner*—Javaid H. Nasri
(74) *Attorney, Agent, or Firm*—Michael D. Smith

(57) ABSTRACT

An electrical connector provides terminal position assurance and wire cover features in a single integrated structure. The connector has a body defining a cavity for receiving one or more terminal carriers having aligned terminal receiving passageways opening at an end surface. A slide member cooperates with the connector body to positionally fix the terminal carrier and to integrally support the wire cover to overlay the end surface to dress conductors emerging there from in a preferred orientation.

21 Claims, 7 Drawing Sheets

ELECTRICAL CONNECTOR WITH INTEGRATED TERMINAL POSITION ASSURANCE AND WIRE COVER

RELATED PATENT APPLICATION

The present application claims priority to provisional application U.S. Ser. No. 60/648,666, filed 31 Jan. 2005, entitled "Integrated TPA and Wire Cover."

TECHNICAL FIELD

The present invention relates to electrical connectors, and more particularly to electrical connector assemblies employing connector body, terminal position and wire dress position assurance features.

BACKGROUND OF THE INVENTION

Electrical connectors for vehicles and the like are often comprised of separate housings that are engaged through pressure, or "snap-fit", upon installation. Snap-fit connectors are desirable because of their ease of installation. However, in order to ensure proper installation, various complexities must be taken into account.

For example, the housings must be securely fastened so that they do not come apart after installation. Additionally, they must be properly aligned so that an electrical connection is made upon installation.

In order to attempt to resolve these and other difficulties, various mechanisms have been used. One especially desirable mechanism is a connector position assurance (CPA) mechanism. CPA mechanisms, placed externally to the housings, are used to assure locking and/or positioning of connector housings.

Use of a CPA may lead to further difficulties when designing a connector. An external CPA may increase the space required for the connector, so that a CPA may be unavailable for a connector to be mounted in a confined space. Accordingly, it would be beneficial to have a small, effectively integrated CPA mechanism for use in electrical connectors.

Multi-pin/contact electrical connectors have a number of terminals and are typically configured in a separate cavity for each terminal. An array of cavities are often closely arranged to conserve packaging space and facilitate assembly. This tends to increase complexity, part count and cost.

Standardized components, such as terminal carriers, can be employed within complex connector assemblies to reduce application specific tooling and assembly costs as well as to provide an integrated terminal position assurance (TPA) feature. It would be desirable to have sub-assemblies of such standardized components.

Current design multi-conductor electrical connectors typically allow wires, which are connected to individual contacts or terminals, to exit directly out of the back of the connector. Routing or dressing the wires, either individually or in a bundled harness form, typically requires the use of additional discrete wire position assurance devices such as tape, clips and the like.

Wire routing is particularly problematic in certain applications such as automobile environments where components are closely packed together. One solution has been the use of wire dress covers, which are formed separately and are attached to the connector assembly to control and guide the exiting wires in a particular orientation.

Although providing certain advantages, wire dress covers add complexity, part count and cost.

U.S. Pat. No. 6,837,751 granted to Mark J. Vanden Wymelenberg, et al. on 4 Jan. 2005 depicts an electrical connector including a connector body, a slide, and a pair of terminal carriers with a plurality of terminals seated in respective terminal seats of the terminal carriers.

With regard to terminal carriers, the superimposed stacking of the terminal carriers with integrated TPS, allows high density row terminal packaging. Furthermore, a large variety of cable/conductor gauges can be accommodated. The removability of the terminal carriers and the flexible arms of the TPA feature described in Vanden Wymekenberg et al. facilitates repair without damage. The TPA feature allows manual or automated plug and unplug features.

Therefore, it is an object of the present invention to provide a compact, multi-conductor electrical connector which provides terminal position assurance and wire cover without adding to part count, manufacturing complexity and cost.

SUMMARY OF THE INVENTION

Generally, the present invention fulfills the forgoing needs by providing, in one aspect thereof, the combination of both TPA and wire cover features in a single, integrated structure.

The presently inventive electrical conductor defines a connector body forming a cavity therein, one or more terminal carriers which define a plurality of terminal receiving passageways therein which open through an end surface of the terminal carrier. A slide member cooperates with the connector body to positionally fix the terminal carrier with respect thereto. Finally, a wire cover is disposed to substantially overlay the terminal carrier end surface and acts to dress conductors emerging from the openings in a preferred orientation. The wire cover is integrally formed with and depends from the slide member. This arrangement has the advantage of affording precise dressing of the emerging wire bundle without adding to part count, manufacturing complexity or cost.

According to an aspect of the invention, the wire cover serves to precisely offset the wires emerging from the terminal carrier passageways. This arrangement allows pre-assembly and pre-dressing of the wires prior to final installation and to avoid nearby obstructions.

According to another aspect of the invention, the wire cover can be configured to selectively dress subsets of wires emerging from the terminal carrier passageways in two or more discrete orientations. The advantage of this arrangement is that each wire can be directed or routed immediately toward its intended interconnection circuit element to minimize wire used while protecting it from adjacent obstructions.

According to yet another aspect of the invention, a second slide member is disposed substantially parallel with the first slide member. Both slide members are integrally formed with the wire cover and each is separately engagable with the connector body, resulting in an extremely robust design, which can provide strain relief for the wire bundles.

These and other features and advantages of this invention will become apparent upon reading the following specification, which, along with the drawings, describes preferred and alternative embodiments of the invention in detail.

BRIEF DESCRIPTION OF THE DRAWINGS

The present invention will now be described, by way of example, with reference to the accompanying drawings, in which.

DESCRIPTION OF THE PREFERRED EMBODIMENT

The present invention is intended for application in automotive vehicle systems and will be described in that context. It is to be understood, however, that the present invention could also be successfully applied in many other applications. Accordingly, the claims herein should not be deemed as limited to the specifics of the preferred embodiment of the invention as described hereunder. The preferred application of the present invention involves the interconnection of electrical or fiber optic conductors in an automotive system and represents an extremely robust, low cost, compact design, which can be easily configured to accommodate application specific packaging requirements. Furthermore, the connector configuration and arrangement enables use of simplified design and manufacturing processes, increasing turnover and lowering cost without adversely impacting quality and reliability.

Figure 1:
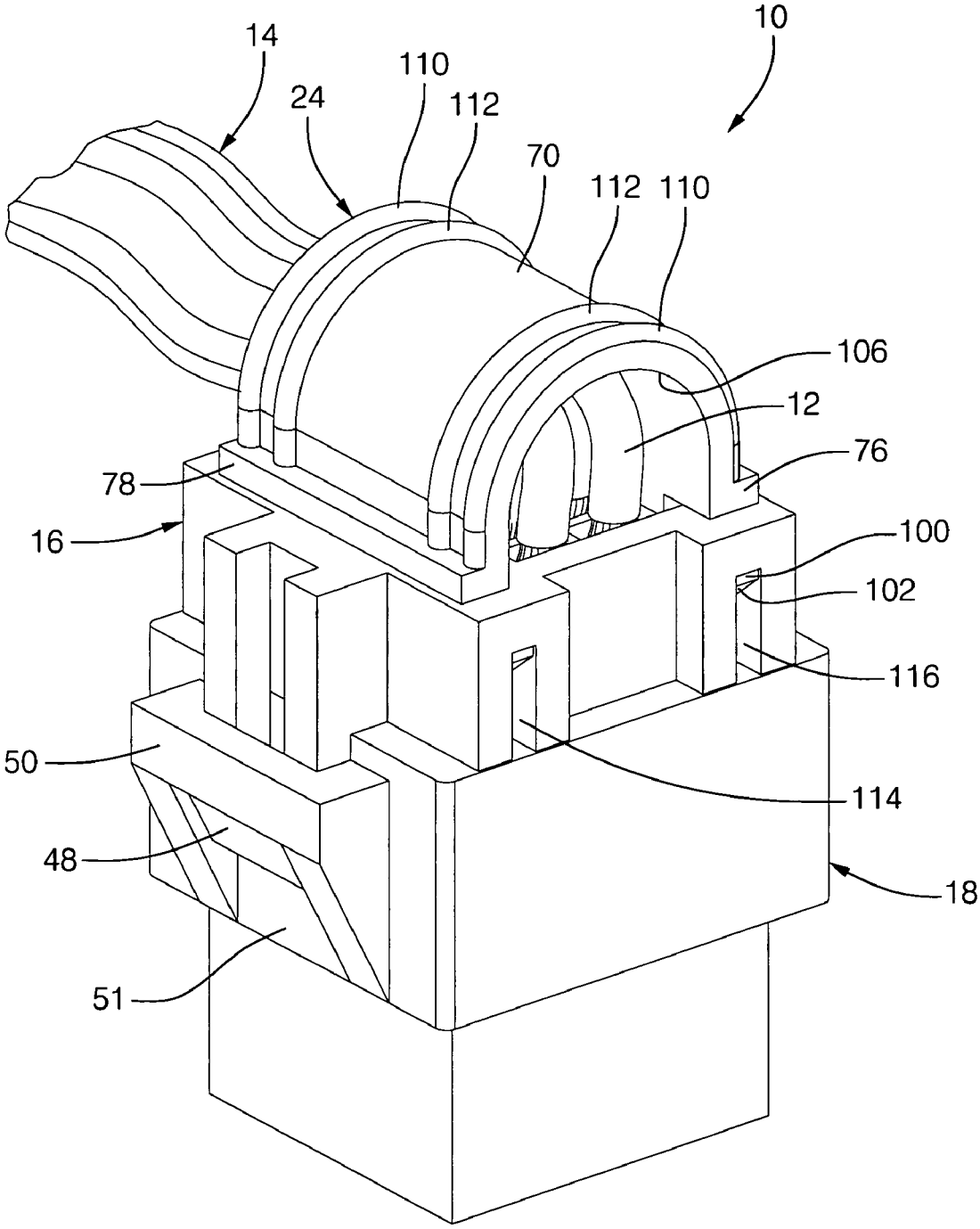
FIG. 1, is a perspective view of the mounted male and female portions of a connector assembly of one embodiment of the present invention.

Referring to FIG. 1, an electrical connector assembly 10 is illustrated in-circuit with a plurality of insulated electrical conductors 12 forming part of a wiring harness 14. Connector assembly 10 includes mating male and female connector portions, 16 and 18, respectively, configured to self-align and nestingly engage to establish a plurality of discrete circuit paths through pairs of isolated conductors.

In application, wiring harness 14 extends from male connector portion 16 toward other system components (not illustrated). Additional electrical conductors (see FIG. 5) likewise extend from female connector portion 18 toward still other system components. Female connector portion 18 may depend from a related segment of wiring harness or be affixed to a housing of an electrical load or associated vehicle structure to assume a fixed design intent orientation.

Figure 2:
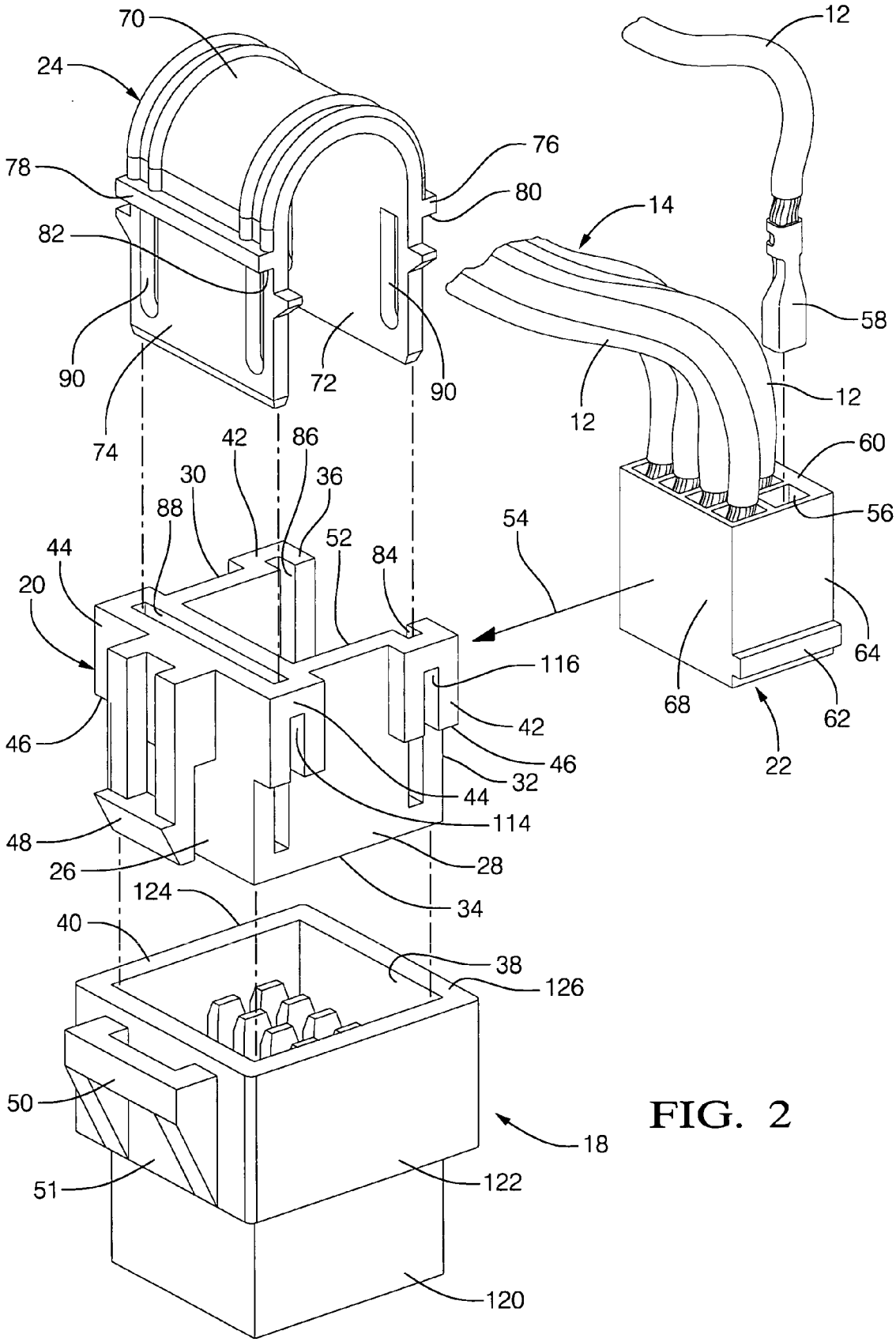
FIG. 2, is an exploded, perspective view of the connector assembly of FIG. 1.

Referring to FIG. 2, male connector portion 16 includes a connector body 20, a terminal carrier 22 and an integrated slide member/wire cover 24. Connector body 20, terminal carrier 22 and slide member/wire cover 24 are each constructed of plastic or other suitable non-electrically conductive material.

Connector body 20 assumes a generally rectangular configuration, defining a rear wall 26, left and right side walls 28 and 30, respectively, a front surface 32, a bottom surface 34 and a top surface 36. When matingly engaged, the connector body 20 of male connector portion 16 is slip fit within a similarly dimensioned upwardly opening cavity 38 formed in the top surface 40 of female connector portion 18. Opposed pairs of front lateral extensions 42 and rear lateral extensions 44 integrally depend from the outer surfaces of side walls 28 and 30, respectively. The lowermost surfaces 46 of extensions 42 and 44 abut top surface 40 of female connector portion 18 to delimit insertion of connector body 20 therein.

A resilient engagement tab 48 is integrally formed on the outer surface of rear wall 26 of connector body 20 and is aligned for snap action engagement with a mating abutment member 50 integrally formed on the rear surface of a rear wall 51 of female connector portion 18. Tab 48 and member 50 collectively constitute a connector position assurance mechanism which reliably rotationally positions the male and female connector portions, 16 and 18, respectively, as well as maintains them in the fully inserted (assembled) condition as illustrated in FIG. 1.

Terminal carrier 22 assumes a generally rectangular configuration and is dimensioned to slip fit within a cavity 52 formed within connector body 20 along an insertion axis designated by arrow 54. Terminal carrier 22 defines a plurality of parallel terminal receiving passageways 56, typically arrayed by rank and file, to maximize compact design and facilitate automatic insertion of electrical terminals 58 which are pre-affixed to individual electrical conductors 12. Passageways 56, as well as any electrical wires 12 contained therein, emerge through the top or end surface 60 of terminal carrier 22.

Cavity 52 opens through both the front surface 32 and top surface 36 of connector body 20. When in the assembled position, an elongated tongue 62 integrally extending from the outer surface of at least one side wall 64 of terminal carrier 22 is disposed within a mating groove 66 formed in the adjacent inwardly facing surface of a side wall 28, 30 of connector body 20 as best viewed in FIG. 5. When assembled, end surface 60 of terminal carrier 22 is flush or co-planer with top surface 36 of connector body 20.

As will be described in detail herein below, electrical terminals 58 are retained within their respective passageway 56 by cooperating self-engaging features. Terminal carrier 22 and electrical terminals 58 collectively constitute an integrated terminal position assurance feature.

When assembled, the outer surface of the rear wall 68 of terminal carrier 22 is in an abutting relation with the inner surface of the rear wall 26 of the connector body 20. Thus positioned, the terminal carrier 22 is contained entirely within the cavity 52 defined by connector body 20. Terminal carrier 22, as well as associated electrical terminals 58 and conductors 12 are locked into a final assembled position (refer FIGS. 3–5) by the integrated slide member/wire cover 24.

Integrated slide member/wire cover 24 comprises an inverted generally "U" shaped integrally formed structure including a semi-cylindrical wire cover portion 70, a front slide member portion 72 and a rear slide member portion 74. Front and rear slide members 72 and 74, respectively, are generally planar and are spaced parallel to one another by a dimension substantially equaling the nominal diameter of wire cover portion 70 and extend downwardly there from. Outwardly extending front and rear steps 76 and 78, respectively, integrally depend from slide member/wire cover 24 at the transition point of wire cover portion 70 and front and rear slide member portions 72 and 74, respectively. The lower faces of steps 76 and 78 define coplanar abutment surfaces 80 and 82, respectively, which, in the final assembled position (refer FIGS. 3–5), abut the top surface 36 of connector body 20.

Connector body 20 defines opposed, inwardly opening vertically extending slots or grooves 84 and 86 formed in the inner surfaces of side walls 28 and 30, respectively, of connector body 20. Furthermore, connector body 20 defines an upwardly opening, laterally extending slot 88 in the rear wall 26 thereof. Opposed slots 84 and 86 are dimensioned and cooperatively configured to receive by slip fit the front slide member portion 72 of slide member/wire cover 24. Likewise, slot 88 in rear wall 26 of connector body 20 is dimensioned to receive by slip fit the rear slide member portion 74 of slide member/wire cover 24.

As best viewed in FIGS. 2 and 5, the male connector portion 16 of electrical connector assembly 10 is preferably assembled as follows. Ends of individual conductors 12 are stripped of insulation and mechanically and electrically affixed to a corresponding electrical terminal 58. Terminals 58 are illustrated as female spade type terminals. However, various other terminal types such as pin connectors or fiber optic connectors could be applied. Each terminal 58 is then inserted downwardly into an associated passageway 56 through top surface 60 of terminal carrier 22 until an integral tang formed in each terminal 58 registers with and releasably engages a recess feature formed within the associated passageway 56 to lock terminal 58 in its illustrated position. The individual conductors 12 are then gathered into generally parallel arrangement to form harness 14.

Figure 3:
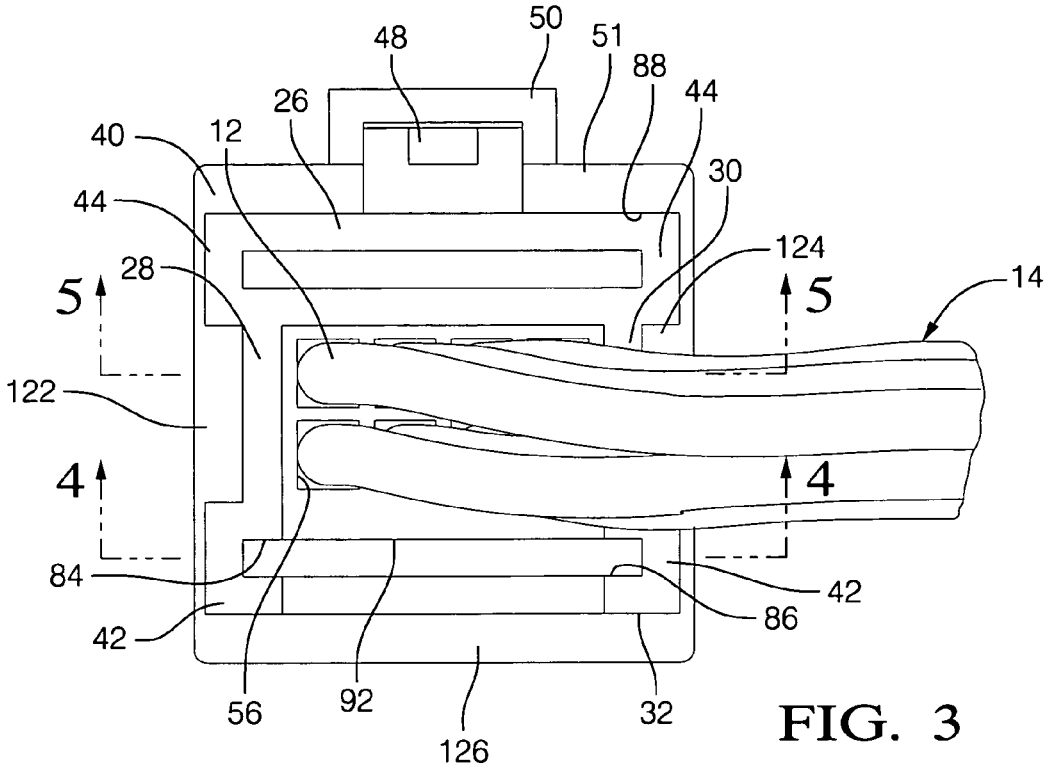
FIG. 3, is top plan view of the connector assembly of FIG. 1, with the wire cover and integral slide members removed.

Next, the terminal carrier 22 is inserted into cavity 52 of connector body 20 along axis 54 until the outer surface of rear wall 68 of carrier 22 abuts the inner surface of the rear wall 26 of connector body 20. When so installed, the carrier 22 is held in its design intent position by the interaction of the tongue 62 and groove 66 and substantially fills cavity 52 as is best illustrated in FIG. 3. Wiring harness 14 is then positioned or dressed in its design intent orientation. Lastly, the slide member/wire cover 24 is inserted downwardly into its assembled position wherein front slide member portion 72 fits within grooves 84 and 86 and rear slide member portion 74 fits within slot 88 until abutment surfaces 80 and 82 contact top surface 36 of connector body 20. Thus positioned, carrier 22 is locked into its illustrated position in the direction of axis 54 by the rear wall 68 of the carrier 22 abutting the rear wall 26 of the connector body 20 and the front wall 92 of the carrier 22 abutting the inwardly facing surface 94 of the front slide member portion 72.

Referring to FIGS. 6–9, the details of the integrated slide member/wire cover 24 are illustrated. Both slide member portions 72 and 74 define vertically extending through slots 90 positioned near the outer edge surfaces 96 thereof to define resilient flexure beams 98. An engagement tab 100 integrally formed with an associated flexure beam 98 at an intermediate location there along extends outwardly there from defining a ramped surface 102 and an abutment surface 104. In the preferred embodiment of the invention, there are four such flexure beams 98 and associated engagement tabs 100. However, there could be more or less such structures. Furthermore, the above described tab 100 latch features could be provided with asymmetries to ensure only a single assembly configuration, preventing misassembly, mispositioning or misalignment of various components, especially placement of the wire cover portion 70 vis-à-vis the connector body 20.

Figure 5:
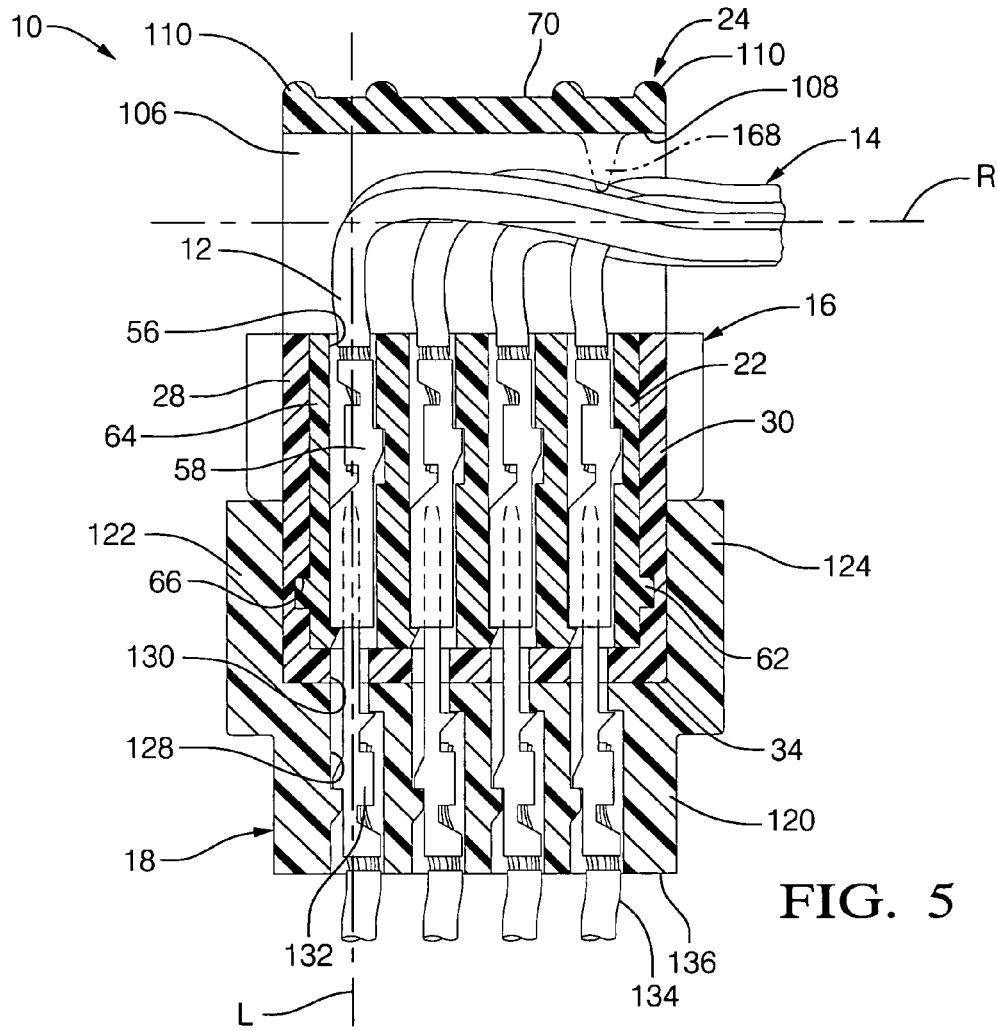
FIG. 5, is a cross-sectional view of the connector assembly of FIG. 1 taken on line 5—5 of FIG. 3, illustrating the details of the interconnecting terminal sets respectively disposed within the male and female connector portions.
Figure 6:
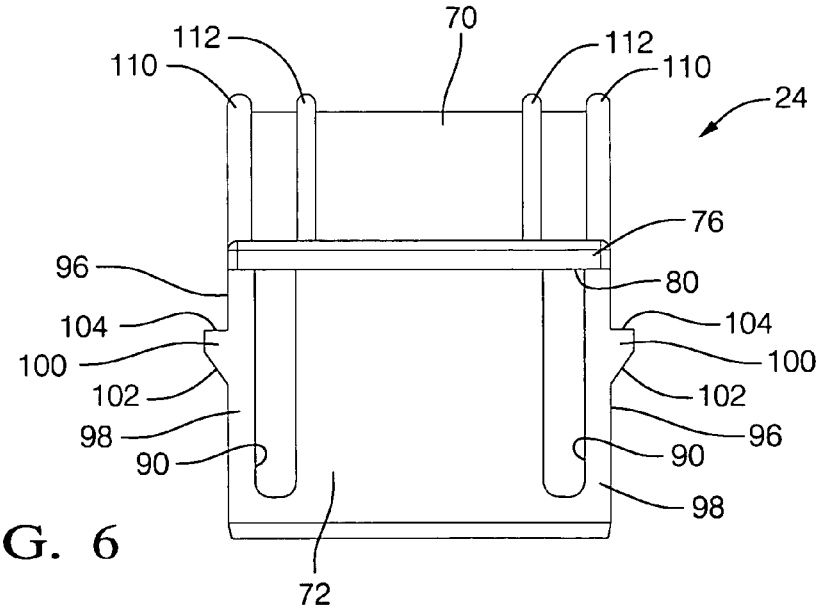
FIG. 6, is a side plan view of an alternative design wire cover and slide members for another embodiment of the invention.
Figure 7:
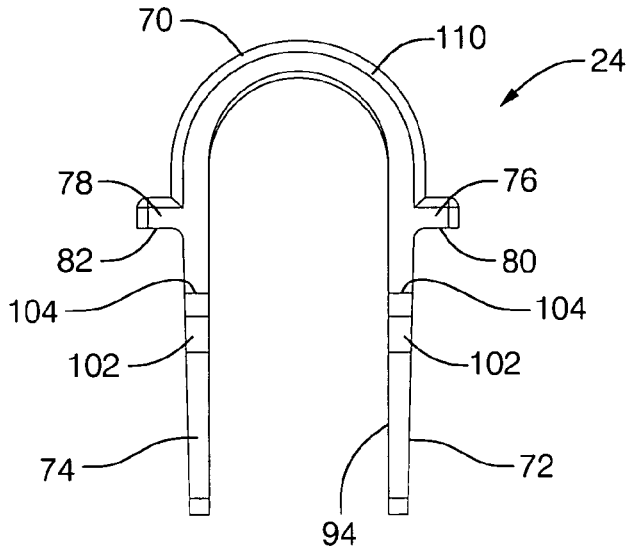
FIG. 7, is an end plan view of the alternative design wire cover and slide members illustrated in FIG. 6.
Figure 8:
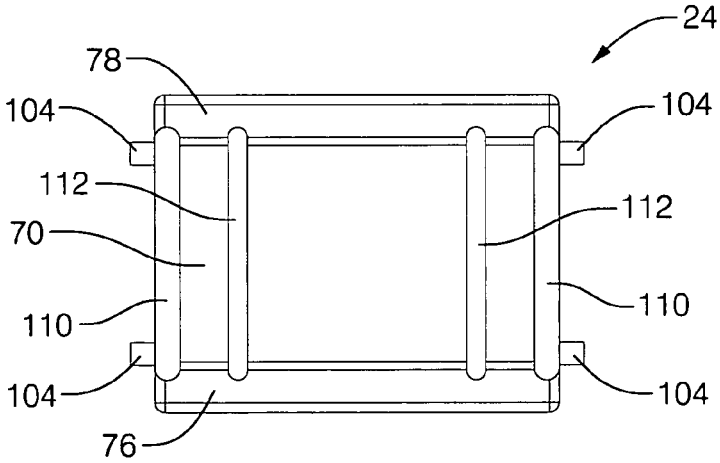
FIG. 8, is a top plan view of the alternative design wire cover and slide members illustrated in FIG. 6.
Figure 9:
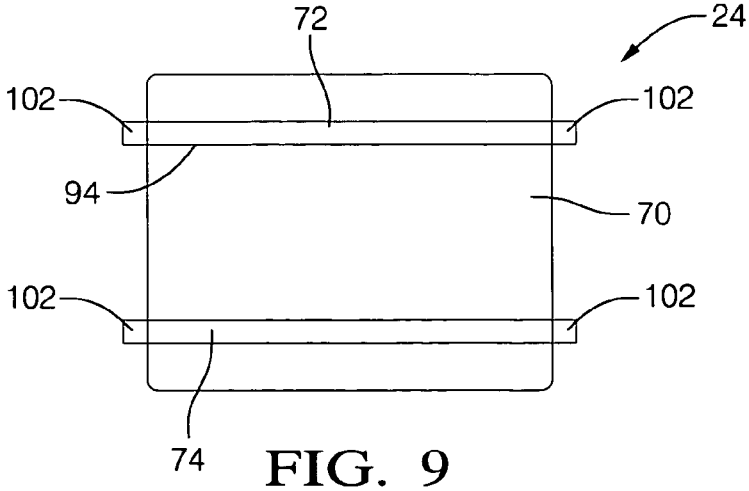
FIG. 9, is a bottom plan view of the alternative design wire cover and slide members illustrated in FIG. 6.
Figure 13:
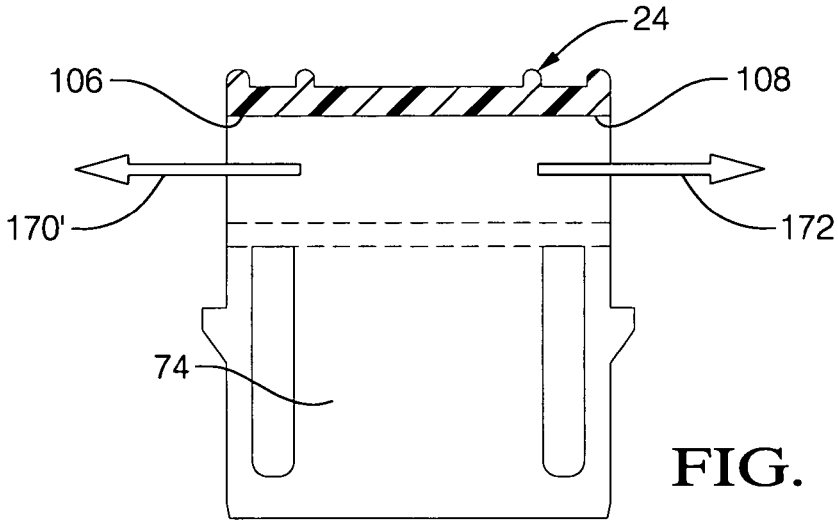
FIG 13, is a simplified, cross-sectional view of the alternative embodiment of FIGS. 6–9 configured to dress conductors in one or both of two distinct orientations identified by reference arrows 170' and 172.

Referring to FIGS. 5,6 and 13, wire cover portion 70 of integrated slide member/wire cover 24 defines first and second open ends 106 and 108, respectively, for selectively routing wires 12 emerging from the upper surface 60 of terminal carrier 22. In FIG. 13, the two distinct potential orientations of the electrical conductors are illustrated by (1) a reference arrow 170' extending through the opening of first open end 106 and (2) a reference arrow 172 extending through the opening of second open end 108. As will be described in connection with alternative embodiments of the invention, a fewer or greater number of such openings can be provided without departing from the spirit of the present invention.

Outer and inner reinforcing bosses or thickening bands 110 and 112 are integrally formed with wire cover portion 70, extending radially outwardly there from. Outer bands 110 are axially disposed adjacent open ends 106 and 108, and inner bands 112 are axially spaced there between to collectively ensure that inadvertent contact with wires 12 dressed to extend there through does not result in deformation of the wire cover portion 70. This permits use of a relatively thin wall section for wire cover portion 70 to conserve material and reduce cost while maintaining a robust design.

Figure 4:
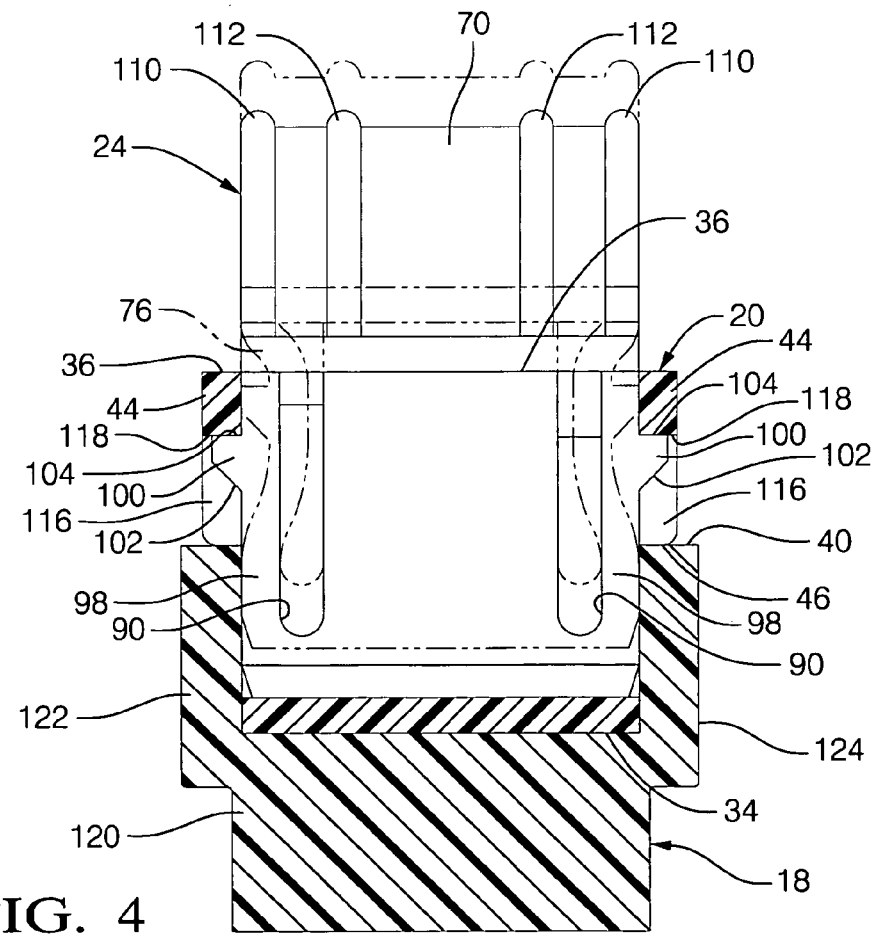
FIG. 4, is a cross-sectional view of the connector assembly of FIG. 1 taken on line 4—4 of FIG. 3, illustrating the engagement of the wire cover and integral slide members with the connector body.

Referring to FIGS. 2 and 4, upon initial insertion of slide member/wire cover 24 into connector body 20, slide member portions 72 and 74 freely slide within grooves 84 & 86 and slot 88, respectively, until the ramp surfaces 102 of the four engagement tabs 100 initially contact the top surface 36 of connector body 20. Thereafter, upon further insertion of slide member portions 72 and 74 into connector body 20, the ramp surfaces 102 of the engagement tabs 100 momentarily resiliently displace flexure beams 98 as is illustrated in phantom.

An additional wire harness 14 strain relief feature can be provided by a radially inwardly directed crimping extension 168 illustrated in FIG. 5 in phantom integrally formed with wire cover portion 70 which, upon final assembly mechanically engages wire harness 14 by compression.

Once the slide member/wire cover 24 is fully inserted into its final assembly position wherein abutment surfaces 80 and 82 contact the top surface 36 of connector body 20, engagement tabs 100 spring outwardly, returning flexure beams 98 to their initial relaxed position. Insodoing, tabs 100 project into side openings 114 and 116 formed in rear and front lateral extensions 44 and 46, respectively, of connector body 20. When slide member/wire cover 24 is in the fully inserted position as illustrated in FIGS. 1 and 4, abutment surfaces 104 of engagement tabs 100 contact respective mating abutment surfaces 118, preventing removal of any portion of slide member/wire cover 24 from its assembled position.

Upon installation of slide member/wire cover 24, the wire cover portion substantially covers the top surface 60 of the terminal carrier 22, as well as the terminal receiving passageways 56 and any wire segments emerging there from. Each terminal receiving passageway 56 has a characteristic line of elongation designated L—L. As individual electrical conductors 12 are gathered to form harness 14, they are offset to follow a line of elongation designated R—R of wire cover portion 70 and exit assembly 10 through second open end 108. Line of elongation L—L is substantially angularly offset from line of elongation R—R. In the preferred embodiment of the invention, this offset is a right angle. However, other angular offsets could be employed depending upon the application.

In the preferred embodiment of the invention, although all conductors 12 are dressed in the same direction along line of elongation R—R, they could alternatively be separated into two groupings or harnesses, with one grouping exiting first open end 106 and the second grouping exiting the second open end 108.

Referring to FIG. 5, the female connector portion 18 of assembly 10 includes a base portion 120, integral side wall portions 122 and 124, front wall portion 126 and rear wall portion 51 collectively defining cavity 38. Base portion 120 defines an array of through passageways 128 which register with related similarly dimensioned through passageways 130 in bottom surface 34 of connector body 20 as well as related through passageways 56 in terminal carrier 22. Through passageways 128 and 130 each have characteristic lines of elongation, which are mutually aligned with L—L. Thus, upon assembly, passageways 56, 130 and 128 cooperate to form an array of through passageways for each electrical terminal 58.

As best viewed in FIG. 5, male spade type electrical terminals 132 are each mechanically and electrically affixed to the end of an associated individual electrical conductor 134 which has its end stripped of insulation. Each terminal 132 is then inserted upwardly into an associated passageway 128 through the bottom surface 136 of base portion 120 until an integral tang formed in each terminal 132 registers and releasably engages a recess feature formed within associated passageway 128. The individual conductors 134 are then gathered into a generally parallel arrangement to form a harness (not illustrated).

Male terminals 132 are elongated and extend upwardly above base portion 120, each passing through an associated passageway 130 in bottom surface 34 of connector body 20 and entering registering passageway 56 of terminal carrier 22. Insodoing, the uppermost end of male terminal 132 electrically couples with its associated female terminal 58 to place electrical conductor 12 in circuit with electrical conductor 134. It is contemplated that watertight seals (not illustrated) can be provided.

Figure 10:
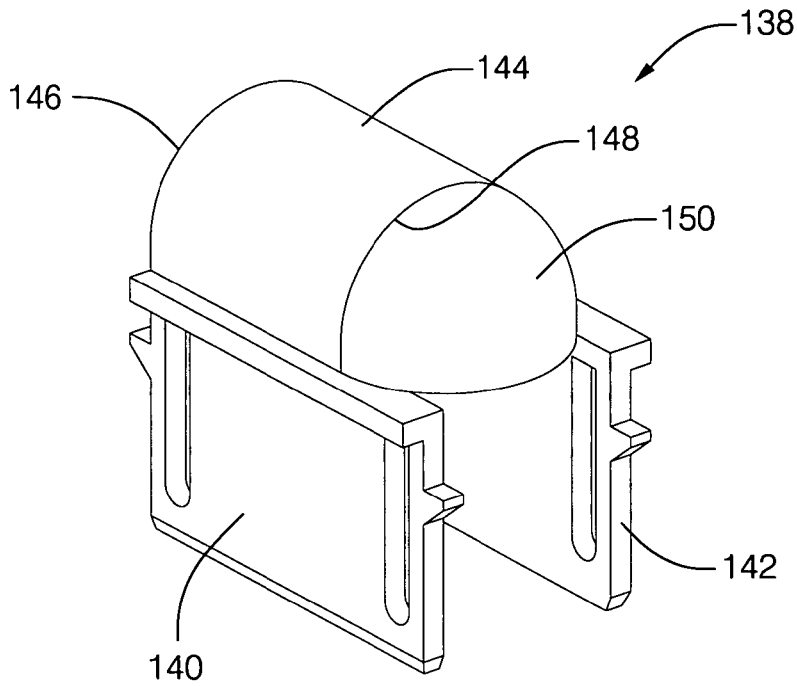
FIG. 10, is a perspective view of a second alternative design wire cover and slide members for still another embodiment of the invention.
Figure 12:
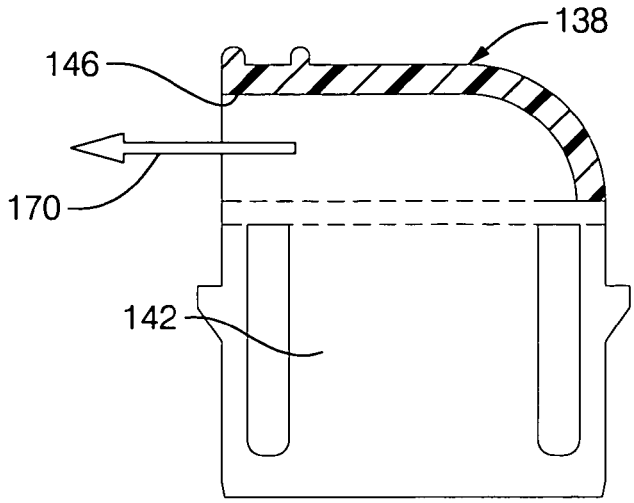
FIG. 12, is a simplified, cross-sectional view of the alternative embodiment of FIG. 10 configured to dress conductors in one distinct orientation identified by reference arrow 170.

Referring to FIGS. 10 and 12, an alternative embodiment of an integral slide member/wire cover 138 is illustrated which is similar in structure and function to slide member/wire cover 24 described hereinabove in all material respects, but for the following exceptions. Slide member/wire cover 138 comprises two discrete spaced parallel slide member portions 140 and 142 integrally formed with a semi-cylindrical wire cover portion 144. One end 146 of wire cover portion 144 defines an opening similar to opening 108 of the preferred embodiment of the invention but which is the sole routing available for exiting electrical conductors. The one distinct orientation of the electrical conductors is illustrated by a reference arrow 170 extending through the side opening in end 146. The opposite end 148 of wire cover portion 144 is sealed by a quartered spherically shaped closure portion 150 integrally formed with wire cover 144.

Figure 11:
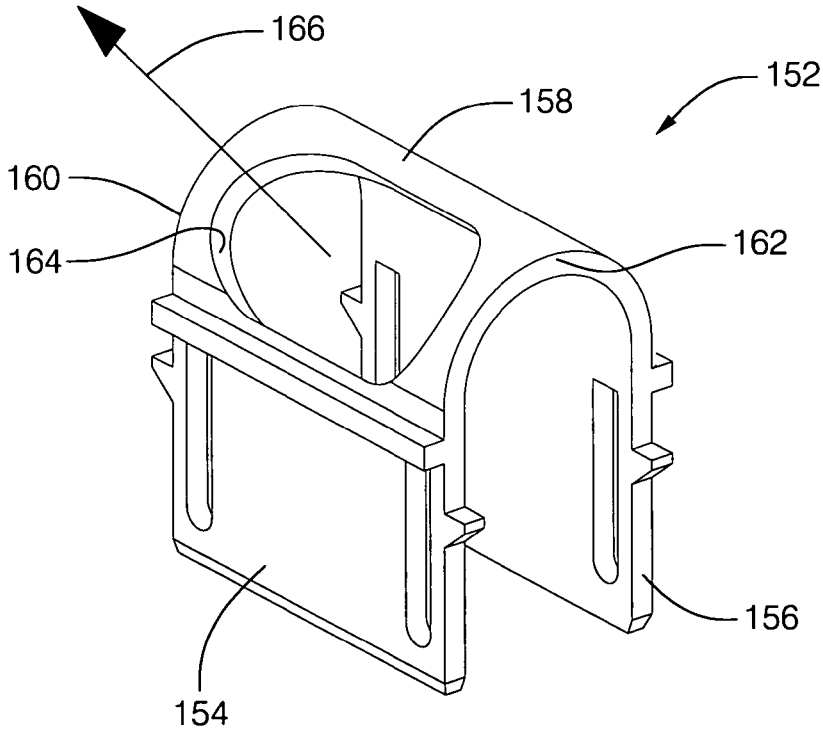
FIG. 11, is a perspective view of a third alternative design wire cover and slide members for yet another embodiment of the invention.
Figure 14:
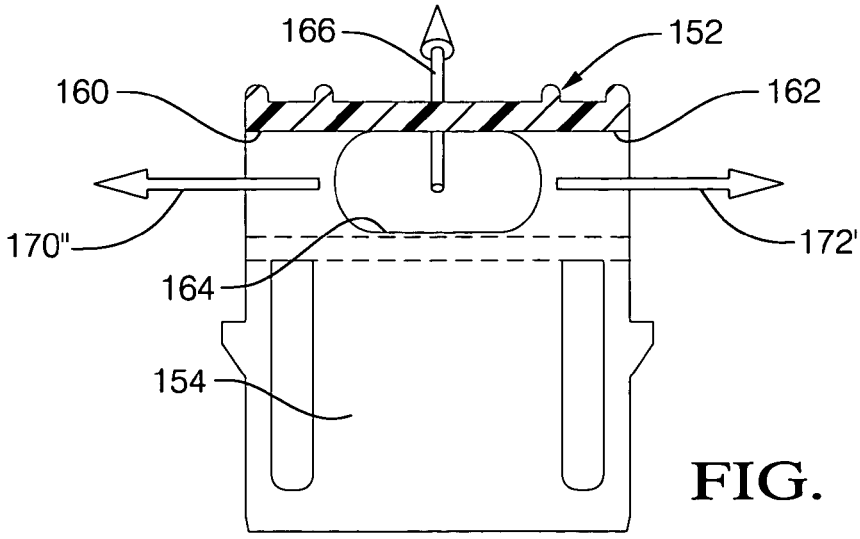
FIG. 14, is a simplified, cross-sectional view of the alternative embodiment of FIG. 11 configured to dress conductors in one, two or three of these distinct orientations identified by reference arrows 170', 172' and 166.

Referring to FIGS. 11 and 14, an additional alternative embodiment of an integral slide member/wire cover 152 is illustrated which is similar in structure and function to slide member/wire cover 24 described hereinabove in all material respects, but for the following exceptions. Slide member/wire cover 152 comprises two discrete spaced parallel slide member portions 154 and 156 integrally formed with a semi-cylindrical wire cover portion 158. A first end 160 of wire cover portion 158 defines an opening similar to opening 108 of the preferred embodiment of the invention and an opposed second end 162 of wire cover portion 158 defines an opening similar to opening 106 of the preferred embodiment of the invention. A third opening 164 is formed in the outer surface of wire cover portion 158 intermediate its ends 160 and 162. The third opening 164 has a characteristic axis of symmetry designated by reference arrow 166 which, in application, is angularly offset from the terminal receiving passageway 56 axis of elongation L—L described hereinabove. The three distinct potential orientations of the electrical conductors are illustrated by (1) a reference arrow 170" extending through the opening in first end 160, (2) a reference arrow 172' extending through the opening in the second end 162 and (3) reference arrow 166 extending through third opening 164.

It is to be understood that the invention has been described with reference to specific embodiments and variations to provide the features and advantages previously described and that the embodiments are susceptible of modification as will be apparent to those skilled in the art.

Furthermore, it is contemplated that many alternative, common inexpensive materials can be employed to construct the basic constituent components. Accordingly, the forgoing is not to be construed in a limiting sense.

The invention has been described in an illustrative manner, and it is to be understood that the terminology, which has been used is intended to be in the nature of words of description rather than of limitation.

Obviously, many modifications and variations of the present invention are possible in light of the above teachings. For example, although the preferred embodiment of the invention has been described as interconnecting pairs of insulated electrically conductive wires, it could also be employed to join fiber optic cable pairs, fluid carrying conduits and the like. Additionally, although the use of two self-locking slide members integrally formed with the wire cover is preferred, it is contemplated that a single slide member integrally formed with the wire cover could be employed in certain applications. It is, therefore, to be understood that within the scope of the appended claims, wherein reference numerals are merely for illustrative purposes and convenience and are not in any way limiting, the invention, which is defined by the following claims as interpreted according to the principles of patent law, including the Doctrine of Equivalents, may be practiced otherwise than as specifically described.

The invention claimed is:

1. An electrical connector comprising:

a connector body defining a cavity therein;

a terminal carrier defining a plurality of terminal receiving passageways opening through an end surface thereof;

a slide member cooperating with said connector body to positionally fix said terminal carrier with respect thereto;

a wire cover disposed to substantially overlay said terminal carrier end surface and to dress conductors emerging from said openings in a predetermined orientation, wherein said wire cover is integrally formed with and depends from said slide member; and an abutment surface integrally formed with said slide member operative to fix said wire cover in a predetermined spacing above said terminal carrier end surface.

2. The electrical connector of claim 1, wherein said terminal receiving passageways have a characteristic line of elongation and said predetermined orientation is substantially offset from said line of elongation.

3. The electrical connector of claim 1, wherein said wire cover is operative to dress conductors emerging from said openings in one of two distinct orientations.

4. The electrical connector of claim 1, wherein said wire cover is operative to dress conductors emerging from said openings in one of three distinct orientations.

5. The electrical connector of claim 1, wherein said slide member comprises a first slide member and, further comprising a second slide member spaced from said first slide member.

6. The electrical connector of claim 5, wherein said first and second slide members are generally planar and disposed substantially parallel to one another.

7. The electrical connector of claim 5, wherein said wire cover bridges and depends from both said slide members.

8. The electrical connector of claim 5, wherein said wire cover is integrally formed with both said slide members.

9. The electrical connector of claim 5, wherein said first and second slide members and wire cover are collectively generally U-shaped in cross-section.

10. The electrical connector of claim 1, wherein said terminal carrier is generally rectangular in shape, defining a characteristic longitudinal length and a lateral width.

11. The electrical connector of claim 10, wherein said slide member extends longitudinally substantially coextensively with said terminal carrier.

12. An electrical connector comprising:

a connector body defining a cavity therein;

a terminal carrier defining a plurality of terminal receiving passageways opening through an end surface thereof;

a slide member cooperating with said connector body to positionally fix said terminal carrier with respect thereto;

a wire cover disposed to substantially overlay said terminal carrier end surface and to dress conductors emerging from said openings in a predetermined orientation, wherein said wire cover is integrally formed with and depends from said slide member, wherein said wire cover is generally semi-cylindrical in shape having an end opening through which said conductors may extend.

13. The electrical connector of claim 12, wherein an opposite end of said wire cover is substantially closed.

14. An electrical connector comprising:

a connector body defining a cavity therein;

a terminal carrier defining a plurality of terminal receiving passageways opening through an end surface thereof;

a slide member cooperating with said connector body to positionally fix said terminal carrier with respect thereto;

a wire cover disposed to substantially overlay said terminal carrier end surface and to dress conductors emerging from said openings in a predetermined orientation, wherein said wire cover is integrally formed with and depends from said slide member, wherein said wire cover is generally semi-cylindrical in shape having opposed open ends through which said conductors may extend.

15. An electrical connector comprising:

a connector body defining a cavity therein;

a terminal carrier defining a plurality of terminal receiving passageways opening through an end surface thereof;

a slide member cooperating with said connector body to positionally fix said terminal carrier with respect thereto;

a wire cover disposed to substantially overlay said terminal carrier end surface and to dress conductors emerging from said openings in a predetermined orientation, wherein said wire cover is integrally formed with and depends from said slide member, wherein said wire cover defines an opening therein at least partially registering with said terminal carrier.

16. An electrical connector comprising:

a connector body defining a cavity therein;

a terminal carrier defining a plurality of terminal receiving passageways opening through an end surface thereof;

a slide member cooperating with said connector body to positionally fix said terminal carrier with respect thereto;

a wire cover disposed to substantially overlay said terminal carrier end surface and to dress conductors emerging from said openings in a predetermined orientation, wherein said wire cover is integrally formed with and depends from said slide member; and latch means operative to effect snap-fit interconnection of said slide member and said connector body.

17. The electrical connector of claim 16, wherein said latch means comprises mating engagement surfaces formed on said slide member and connector body.

18. The electrical connector of claim 17, wherein the engagement surface associated with said slide member is defined by a projection extending from a resilient beam portion integrally formed therein.

19. An electrical connector comprising:

a connector body defining a cavity therein;

a terminal carrier defining a plurality of terminal receiving passageways opening through an end surface thereof;

a slide member cooperating with said connector body to positionally fix said terminal carrier with respect thereto;

a wire cover disposed to substantially overlay said terminal carrier end surface and to dress conductors emerging from said openings in a predetermined orientation, wherein said wire cover is integrally formed with and depends from said slide member; and positioning means operative to fix wire cover in a predetermined spacing above said terminal carrier end surface, wherein said positioning means comprises a longitudinally extending abutment surface integrally formed in said slide member.

20. An electrical connector comprising:

a connector body defining a cavity therein;

a terminal carrier defining a plurality of terminal receiving passageways opening through an end surface thereof;

a slide member cooperating with said connector body to positionally fix said terminal carrier with respect thereto;

a wire cover disposed to substantially overlay said terminal carrier end surface and to dress conductors emerging from said openings in a predetermined orientation, wherein said wire cover is integrally formed with and depends from said slide member; and localized wire cover reinforcing means.

21. The electrical connector of claim 20, wherein said localized wire cover reinforcing means comprises at least one circumferential ring integrally formed on an outer surface of said wire cover.

* * * * *